US006960120B2

(12) United States Patent
Prasad

(10) Patent No.: US 6,960,120 B2
(45) Date of Patent: Nov. 1, 2005

(54) CMP PAD WITH COMPOSITE TRANSPARENT WINDOW

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/361,520

(22) Filed: Feb. 10, 2003

(65) Prior Publication Data

US 2004/0157533 A1 Aug. 12, 2004

(51) Int. Cl.[7] ..... B24B 1/00

(52) U.S. Cl. ..... 451/41; 451/6; 451/8; 451/9; 451/286; 451/287; 451/288; 451/526; 451/921

(58) Field of Search ..... 451/6, 8, 9, 41, 451/286, 287, 288, 526, 921

(56) References Cited

U.S. PATENT DOCUMENTS

| | | | | |
|---|---|---|---|---|
| 5,433,651 | A | 7/1995 | Lustig et al. | |
| 5,605,760 | A | 2/1997 | Roberts | |
| 5,893,796 | A | 4/1999 | Birang et al. | |
| 5,964,643 | A | 10/1999 | Birang et al. | |
| 6,146,242 | A | 11/2000 | Treur et al. | |
| 6,171,181 | B1 | 1/2001 | Roberts et al. | |
| 6,387,312 | B1 | 5/2002 | Roberts et al. | |
| 6,447,369 | B1 * | 9/2002 | Moore | 451/6 |
| 6,537,134 | B2 * | 3/2003 | Newell | 451/6 |
| 6,604,985 | B2 * | 8/2003 | Muilenburg et al. | 451/6 |
| 6,641,471 | B1 * | 11/2003 | Pinheiro et al. | 451/526 |
| 6,860,793 | B2 * | 3/2005 | Budinger et al. | 451/41 |
| 2001/0031610 | A1 | 10/2001 | Budinger et al. | |
| 2001/0053658 | A1 | 12/2001 | Budinger et al. | |
| 2002/0072296 | A1 | 6/2002 | Muilenburg et al. | |
| 2002/0077037 | A1 | 6/2002 | Tietz | |

* cited by examiner

*Primary Examiner*—Joseph J. Hail, III
*Assistant Examiner*—Shantese McDonald
(74) *Attorney, Agent, or Firm*—Caryn Borg-Breen

(57) ABSTRACT

The invention is directed to chemical-mechanical polishing pads comprising a transparent window. In one embodiment, the transparent window comprises an inorganic material and an organic material, wherein the inorganic material comprises about 20 wt. % or more of the transparent window. In another embodiment, the transparent window comprises an inorganic material and an organic material, wherein the inorganic material is dispersed throughout the organic material and has a dimension of about 5 to 1000 nm, and wherein the transparent window has a total light transmittance of about 30% or more at at least one wavelength in the range of about 200 to 10,000 nm. In yet another embodiment, the transparent window comprises an inorganic/organic hybrid sol-gel material. In an additional embodiment, the transparent window comprises a polymer resin and a clarifying material, wherein the transparent window has a total light transmittance that is substantially higher than a window comprising only the polymeric resin.

43 Claims, No Drawings

CMP PAD WITH COMPOSITE TRANSPARENT WINDOW

FIELD OF THE INVENTION

This invention pertains to a polishing pad comprising a composite window material for use with in situ chemical-mechanical polishing detection methods.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ. One method of monitoring the polishing process in situ involves the use of a polishing pad having an aperture or window. The aperture or window provides a portal through which light can pass to allow the inspection of the wafer surface during the polishing process. Polishing pads having apertures and windows are known and have been used to polish substrates, such as the surface of semiconductor devices. For example, U.S. Pat. No. 5,605,760 provides a pad having a transparent window formed from a solid, uniform polymer, which has no intrinsic ability to absorb or transport slurry. U.S. Pat. No. 5,433,651 discloses a polishing pad wherein a portion of the pad has been removed to provide an aperture through which light can pass. U.S. Pat. Nos. 5,893,796 and 5,964,643 disclose removing a portion of a polishing pad to provide an aperture and placing a transparent polyurethane or quartz plug in the aperture to provide a transparent window, or removing a portion of the backing of a polishing pad to provide a translucency in the pad. U.S. Pat. Nos. 6,171,181 and 6,387,312 disclose a polishing pad having a transparent region that is formed by solidifying a flowable material (e.g., polyurethane) at a rapid rate of cooling.

Only a few materials have been disclosed as useful for polishing pad windows. U.S. Pat. No. 5,605,760 discloses the use of a solid piece of polyurethane. U.S. Pat. Nos. 5,893,796 and 5,964,643 disclose the use of either a polyurethane plug or a quartz insert. U.S. Pat. No. 6,146,242 discloses a polishing pad with a window comprising either polyurethane or a clear plastic such as Clariflex™ tetrafluoroethylene-co-hexafluoropropylene-co-vinylidene fluoride terpolymer sold by Westlake. Polishing pad windows made of a solid polyurethane are easily scratched during chemical-mechanical polishing, resulting in a steady decrease of the optical transmittance during the lifetime of the polishing pad. This is particularly disadvantageous because the settings on the endpoint detection system must be constantly adjusted to compensate for the loss in optical transmittance. In addition, pad windows, such as solid polyurethane windows, typically have a slower wear rate than the remainder of the polishing pad, resulting in the formation of a "lump" in the polishing pad, which leads to undesirable polishing defects. To address some of these problems, WO 01/683222 discloses a window having a discontinuity that increases the wear rate of the window during CMP. The discontinuity purportedly is generated in the window material by incorporating into the window either a blend of two immiscible polymers or a dispersion of solid, liquid, or gas particles.

While many of the known window materials are suitable for their intended use, there remains a need for effective polishing pads having translucent regions that can be produced using efficient and inexpensive methods. The invention provides such a polishing pad, as well as methods of its use. These and other advantages of the present invention, as well as additional inventive features, will be apparent from the description of the invention provided herein.

BRIEF SUMMARY OF THE INVENTION

The invention provides a polishing pad for chemical-mechanical polishing comprising a transparent window made of a composite material. In one embodiment, the transparent window comprises at least one inorganic material and at least one organic material, wherein the inorganic material comprises about 20 wt. % or more of the transparent window based on the total weight of the transparent window. In another embodiment, the transparent window comprises at least one inorganic material and at least one organic material, wherein the inorganic material is dispersed throughout the organic material and has a dimension of about 5 nm to about 1000 nm, and wherein the transparent window has a total light transmittance of about 30% or more at at least one wavelength in the range of about 200 nm to about 10,000 nm. In yet another embodiment, the transparent window comprises an inorganic/organic hybrid sol-gel material. In an additional embodiment, the transparent window comprises at least one polymeric resin and at least one clarifying agent such that the transparent window has a total light transmittance that is substantially higher than a window comprising only the polymeric resin.

The invention further provides a chemical-mechanical polishing apparatus and a method of polishing a workpiece. The CMP apparatus comprises (a) a platen that rotates, (b) a polishing pad of the invention, and (c) a carrier that holds a workpiece to be polished by contacting the rotating polishing pad. The method of polishing comprises the steps of (i) providing a polishing pad of the invention, (ii) contacting a workpiece with the polishing pad, and (iii) moving the polishing pad relative to the workpiece to abrade the workpiece and thereby polish the workpiece.

DETAILED DESCRIPTION OF THE INVENTION

The invention is directed to a polishing pad for chemical-mechanical polishing comprising a transparent window, wherein the transparent window is made of a composite of two or more materials. Typically, the two or more materials are physically and/or chemical distinct from one another. The transparent window can be a portion within a polishing pad, or the transparent window can be the entire polishing pad (e.g., the entire polishing pad or polishing top pad is transparent and comprises a composite of two or more materials).

In a first embodiment, the transparent window comprises at least one inorganic material and at least one organic material. The inorganic material can be any suitable inorganic material. For example, the inorganic material can be an inorganic fiber or inorganic particle. Suitable inorganic materials include metal oxide particles (e.g., silica, alumina, and ceria particles), silicon carbide particles, glass fibers, glass beads, diamond particles, carbon fibers, and phyllosilicate materials such as micas (e.g., fluorinated micas) and clays having an aspect ratio of about 50 or greater (e.g., about 100 to about 200). Suitable clays include montmorillonite, kaolinite, and talc, wherein the surface of the clays has been treated with onium ions. Preferably, the inorganic material is selected from the group consisting of silica particles, alumina particles, ceria particles, diamond particles, glass fibers, carbon fibers, glass beads, mica particles, and combinations thereof. The inorganic material typically has a dimension of about 1 micron or less (e.g., about 0.1 nm to about 900 nm, about 1 nm to about 800 nm, or even about 10 nm to about 700 nm).

The organic material can be any suitable organic material. Typically, the organic material is a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. Preferably, the organic material is a thermoplastic polyurethane polymer resin.

The inorganic material is present in the transparent window in an amount of about 20 wt. % or more (e.g., about 30 wt. % or more, about 40 wt. % or more, or even about 50 wt. % or more) of the transparent window based on the total weight of the transparent window. Preferably, the inorganic material comprises about 95 wt. % or less (e.g., about 90 wt. % or less, or even about 85 wt. % or less) of the transparent window based on the total weight of the transparent window.

The inorganic material can be distributed through the organic material by any suitable method and in any suitable pattern. For example, the inorganic material can be dispersed throughout the organic material, across a surface (e.g., a surface that is contacted with a substrate during polishing, i.e., a "polishing surface") of the organic material, or a combination thereof. Preferably, the inorganic material is uniformly dispersed throughout the organic material.

The inclusion of the inorganic material into the organic material is not intended to cause the transparent window to have enhanced abrasive properties. Rather, the inclusion of the inorganic material is intended to either improve the mechanical properties (e.g., strength) or light transmittance properties of the transparent window. Preferably, the presence of the inorganic material does not substantially alter the abrasive properties of the transparent window.

The inclusion of the inorganic material into the organic material may cause a decrease in the light transmittance relative to the total light transmittance of the organic material alone. The extent of loss of light transmittance can be controlled by balancing the size of the inorganic materials with the relative amount of the inorganic material and organic material incorporated into the transparent window. The balance of those factors will depend, at least in part, on the type of inorganic material and organic material being used.

The transparent window comprising the inorganic material and the organic material has a total light transmittance of about 10% or more (e.g., about 20% or more, or even about 30% or more) at at least one wavelength in the range of about 200 nm to about 10,000 nm (e.g., about 200 nm to about 5,000 nm, or even about 200 nm to about 2,000 nm). This means that there is at least one wavelength of light within the stated range for which the transparent window of the invention has a total light transmittance of about 10% or more (e.g., about 20% or more, or even about 30% or more). There can be more than one wavelength, or even a range of wavelengths, for which the transparent window of the invention has a total light transmittance of about 10% or more (e.g., about 20% or more, or even about 30% or more). Preferably, the transparent window has a total light transmittance of about 10% or more (e.g., about 20% or more, or even about 30% or more) at at least one wavelength in the range of about 200 nm to about 1000 nm (e.g., about 200 nm to about 800 nm). In some embodiments, the window has a total light transmittance of about 90% or less (e.g., about 80% or less, or even about 70% or less) at one or more wavelengths in the range of about 200 nm to about 10,000 nm (e.g., about 200 nm to about 5,000, or even about 200 nm to about 1000 nm).

In a second embodiment, the transparent window comprises at least one inorganic material and at least one organic material, wherein the inorganic material has a dimension of about 5 nm to about 1000 nm (e.g., about 10 nm to about 700 nm) and the transparent window has a total light transmittance of about 30% or more (e.g., about 40% or more, or even about 50% or more) at at least one wavelength in the range of about 200 nm to about 10,000 nm (e.g., about 200 nm to about 1,000 nm, or even about 200 nm to about 800 nm). The inorganic material is dispersed, preferably uniformly dispersed, throughout the organic material.

The inorganic material and organic material of this second embodiment can be any of those described above with respect to the first embodiment. The inorganic material can be present in any suitable amount. Typically, the inorganic material comprises about 1 wt. % to about 95 wt. % (e.g., about 5 wt. % to about 75 wt. %, or even about 5 wt. % to about 50 wt. %) of the transparent window based on the total weight of the transparent window. The inorganic material can be distributed through the organic material by any suitable method and in any suitable pattern as described above with respect to the first embodiment.

In a third embodiment, the transparent window comprises a hybrid organic-inorganic sol-gel material. A sol-gel is a three-dimensional metal oxide network (e.g., siloxane network) that has a controllable pore size, surface area, and pore size distribution. Sol-gels can be prepared using a variety of methods, many of which are known in the art. Suitable methods include single-step (e.g., "one-pot") methods and two-step methods. A typical method involves the use of metal alkoxide precursors (e.g., $M(OR)_4$, wherein M is Si, Al, Ti, Zr, or a combination thereof, and R is an alkyl, aryl, or a combination thereof) which when placed in a solvent containing water and an alcohol, undergo hydrolysis of the alkoxide ligands and condensation (e.g., polycondensation) resulting in formation of M-O-M linkages (e.g., Si—O—Si siloxane linkages). As the number of M-O-M linkages increases, a three-dimensional network is formed having a microcellular pore structure. Hybrid sol-gel materials are a subclass of such sol gel materials. Organic-inorganic hybrid materials are prepared using chemical precursors containing both inorganic and organic groups. When a three-dimensional network is formed from such precursors, the organic groups can become trapped inside the pore structure. The pore size can be controlled through the selection of an appropriate organic group. Such hybrid organic-inorganic materials can be transparent and have properties similar to glass. Examples of suitable hybrid sol-gel materials include clay-polyamide hybrid materials and metal oxide-polymer resin hybrid materials (e.g., silica-polymer hybrids). Such sol-gel composites can be prepared using any suitable precursor reagents and following any suitable method, many of which are known in the art. For example, silica-polymer nanocomposites can be prepared by hydrolysis and condensation of diblock copolymers with organically-modified aluminosilicate or silica-type ceramic materials.

In a fourth embodiment, the polishing pad comprises a transparent window comprising at least one polymer resin and at least one clarifying material. The inclusion of the clarifying material with the polymer resin results in an increase in the light transmittance of the transparent window relative to the light transmittance of a material comprising the polymer resin in the absence of the clarifying material. The transparent window has a total light transmittance of about 30% or more (e.g., about 40% or more, or even 50% or more) at at least one wavelength in the range of about 200 nm to about 10,000 nm (e.g., about 200 nm to about 1,000 nm).

The polymer resin can be any suitable polymer resin. Typically, the polymer resin is selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. Preferably, the polymer resin is a thermoplastic polyurethane, a nylon, a polypropylene, or a polyethylene polymer resin.

The clarifying material can be any suitable clarifying material. Typically, the clarifying material is selected from the group consisting of phyllosilicates such as clays and micas, metal oxides, inorganic salts, saccharides (e.g., Millad® polysaccharide clarifiers sold by Milliken Chemical and sorbitol), polymer fibers (e.g., polyamide fibers), and combinations thereof. When the clarifying material is a clay, the clay preferably is selected from the group consisting of talc, kaolinite, montmorillonite, hectorite, and combinations thereof. More preferably, the surface of the clays described above has been treated with onium ions (e.g., phosphonium ions, ammonium ions, sulfonium ions, and the like). When the clarifying material is a mica, the mica preferably is a fluorinated mica. When the clarifying material is a metal oxide, the metal oxide can be any suitable metal oxide and is preferably titania. When the clarifying material is an inorganic salt, the inorganic salt can be any suitable metal salt and is preferably calcium carbonate or sodium benzoate.

The selection of the clarifying material will depend, at least in part, on the polymer resin being used. When the polymer resin is nylon, the clarifying material preferably is talc, montmorillonite, fluorinated mica, or a combination thereof. When the polymer resin is polypropylene, the clarifying material preferably is talc, titania, sodium benzoate, sorbital, polysaccharide, calcium carbonate, or a combination thereof. When the polymer resin is polyethylene, the clarifying material preferably is talc.

The clarifying material and the polymer resin can be combined to form a window material using any suitable technique, many of which are known in the art. For example, a clarifying material such as a phyllosilicate clay or mica can be combined with a melt of the polymer resin and blended such that the clarifying material becomes dispersed throughout the polymer resin. During this combining step, it is preferable that at least a portion of the polymer resin intercalates between the layers of the clay or mica. The mixture of the polymer resin and clarifying material then can be extruded so as to form a transparent, or substantially transparent, sheet from which the window can be cut. It will be appreciated by those of skill in the art that the transparent window material can be prepared by a variety of techniques including extrusion, cast molding, sintering, thermoforming, and the like.

The clarifying materials typically have a dimension (e.g., average particle size) of about 1 nm to about 10 microns (e.g., about 5 microns or less, or about 3 microns or less). When the clarifying material is a clay, the clay preferably has an aspect ratio of about 50 or greater (e.g., about 100 to about 200). Such clays typically have thickness of about 10 nm to about 20 nm and a length of about 100 nm to about 1000 nm. When the clarifying material is a mica, the mica preferably has an aspect ratio of about 50 or greater (e.g., about 100 to about 200), a thickness of about 10 nm to about 20 nm, and a length of about 100 nm to about 1000 nm.

The transparent window of this fourth embodiment can comprise any suitable amount of the clarifying material. Typically, the amount of the clarifying material is about 0.0001 wt. % or more (e.g., about 0.001 wt. % or more, or even about 0.01 wt. % or more), based on the total weight of the transparent window. Preferably, the amount of the clarifying material is about 10 wt. % or less (e.g., about 5 wt. % or less, about 2 wt. % or less, or even about 0.5 wt. % or less), based on the total weight of the transparent window. The amount of the clarifying material present in the transparent window will depend, in part, on the polymer resin being used. For example, when the polymer resin is polypropylene, typically about 0.2 wt. % or less sorbitol or polysaccharide is used. Similarly, when the polymer resin is nylon, typically about 0.2 wt. % or less of talc, montmorillonite, or fluorinated mica is used. The addition of larger amounts of the clarifying material may be desirable to improve the strength or stiffness of the resulting polymeric material.

The transparent window of any of the embodiments of the inventive polishing pad optionally further comprises a dye (or pigment), which enables the substrate to selectively transmit light of a particular wavelength(s). The dye acts to filter out undesired wavelengths of light (e.g., background light) and thus improve the signal to noise ratio of detection. The transparent window can comprise any suitable dye or may comprise a combination of dyes. Suitable dyes include polymethine dyes, di- and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

When the transparent window of any of the embodiments of the inventive polishing pad constitutes only a portion of the polishing pad, the window can be mounted into the polishing pad using any suitable technique. For example, the window can be mounted into the polishing pad through the use of adhesives. The window can be mounted into the top portion of the polishing pad (e.g., the polishing surface), or can be mounted into the bottom portion of the polishing pad (e.g., the subpad). The transparent window can have any suitable dimensions and can be round, oval, square, rectangular, triangular, and so on. The transparent window can be positioned so as to be flush with the polishing surface of the polishing pad, or can be recessed from the polishing surface of the polishing pad. The polishing pad can comprise one or more of the transparent windows of the invention. The transparent window(s) can be placed in any suitable position on the polishing pad relative to the center and/or periphery of the polishing pad.

The polishing pad into which the transparent window is placed can be made of any suitable polishing pad material, many of which are known in the art. The polishing pad typically is opaque or only partially translucent. The polishing pad can comprise any suitable polymer resin. For example, the polishing pad typically comprises a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. The polishing pad can be produced by any suitable method including sintering, injection molding, blow molding, extrusion, and the like. The polishing pad can be solid and non-porous, can contain microporous closed cells, can contain open cells, or can contain a fibrous web onto which a polymer has been molded.

Polishing pads of the invention have a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

Polishing pads of the invention can comprise, in addition to the transparent window, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

Polishing pads of the invention are particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad.

The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, antifoaming agents, and the like. The CMP apparatus can be any suitable CMP apparatus, many of which are known in the art. The polishing pad of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pads described herein can be used alone or optionally can be used as one layer of a multi-layer stacked polishing pad. For example, the polishing pads can be used in combination with a subpad. The subpad can be any suitable subpad. Suitable subpads include polyurethane foam subpads (e.g., Poron® foam subpads from Rogers Corporation), impregnated felt subpads, microporous polyurethane subpads, or sintered urethane subpads. The subpad typically is softer than the polishing pad of the invention and therefore is more compressible and has a lower Shore hardness value than the polishing pad of the invention. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pads of the invention are used in combination with a subpad, typically there is an intermediate backing layer such as a polyethyleneterephthalate adhesive film, coextensive with and between the polishing pad and the subpad.

Polishing pads of the invention are suitable for use in polishing many types of workpieces (e.g., substrates or wafers) and workpiece materials. For example, the polishing pads can be used to polish workpieces including memory storage devices, semiconductor substrates, and glass substrates. Suitable workpieces for polishing with the polishing pads include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for chemical-mechanical polishing comprising a transparent window, wherein the transparent window comprises at least one inorganic material and at least one organic material, and wherein the inorganic material comprises about 20 wt. % or more of the transparent window based on the total weight of the transparent window.

2. The polishing pad of claim 1, wherein the transparent window has a total light transmittance of about 10% or more at at least one wavelength in the range of about 200 nm to about 10,000 nm.

3. The polishing pad of claim 2, wherein the transparent window has a total light transmittance of about 10% or more at at least one wavelength in the range of about 200 nm to about 1,000 nm.

4. The polishing pad of claim 1, wherein the inorganic material is an inorganic fiber or inorganic particle.

5. The polishing pad of claim 4, wherein the inorganic material is selected from the group consisting of silica particles, alumina particles, ceria particles, diamond particles, glass fibers, carbon fibers, glass beads, mica particles, and combinations thereof.

6. The polishing pad of claim 1, wherein the inorganic material has a dimension of about 1 micron or less.

7. The polishing pad of claim 6, wherein the inorganic material has a dimension of about 0.1 nm to about 700 nm.

8. The polishing pad of claim 1, wherein the organic material is a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, polystyrenes, polymethylmethacrylates, copolymers thereof, and mixtures thereof.

9. The polishing pad of claim 8, wherein the polymer resin is a thermoplastic polyurethane.

10. The polishing pad of claim 1, wherein the inorganic material comprises about 30 wt. % or more of the transparent window based on the total weight of the transparent window.

11. The polishing pad of claim 1, wherein the inorganic material comprises about 95 wt. % or less of the transparent window based on the total weight of the transparent window.

12. The polishing pad of claim 1, wherein the inorganic material is dispersed throughout the organic material.

13. The polishing pad of claim 1, wherein the inorganic material is dispersed across a surface of the organic material.

14. A chemical-mechanical polishing apparatus comprising:

(a) a platen that rotates, (b) a polishing pad comprising a transparent window, wherein the transparent window comprises at least one inorganic material and at least one organic material, and wherein the inorganic material comprises about 20 wt. % or more of the transparent window based on the total weight of the transparent window, and (c) a carrier that holds a substrate to be polished by contacting the rotating polishing pad.

15. The chemical-mechanical polishing apparatus of claim 14, further comprising an in situ polishing endpoint detection system.

16. A method of polishing a workpiece comprising (i) providing a polishing pad comprising a transparent window, wherein the transparent window comprises at least one inorganic material and at least one organic material, and wherein the inorganic material comprises about 20 wt. % or more of the transparent window based on the total weight of the transparent window, (ii) contacting a workpiece with the polishing pad, and (iii) moving the polishing pad relative to the workpiece to abrade the workpiece and thereby polish the workpiece.

17. A polishing pad for chemical-mechanical polishing comprising a transparent window, wherein the transparent window comprises at least one inorganic material and at least one organic material, wherein the inorganic material is dispersed throughout the organic material and has a dimension of about 5 nm to about 1000 nm, and wherein the transparent window has a total light transmittance of about 30% or more at at least one wavelength in the range of about 200 nm to about 10,000 nm.

18. The polishing pad of claim 17, wherein the transparent window has a total light transmittance of about 30% or more at at least one wavelength in the range of about 200 nm to about 1,000 nm.

19. The polishing pad of claim 17, wherein the inorganic material has a dimension of about 10 nm to about 700 nm.

20. The polishing pad of claim 17, wherein the inorganic material comprises about 5 wt. % to about 75 wt. % of the transparent window based on the total weight of the transparent window.

21. The polishing pad of claim 17, wherein the organic material is a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof.

22. The polishing pad of claim 21, wherein the polymer resin is a thermoplastic polyurethane.

23. A chemical-mechanical polishing apparatus comprising:

(a) a platen that rotates, (b) a polishing pad comprising a transparent window, wherein the transparent window comprises at least one inorganic material and at least one organic material, wherein the inorganic material is dispersed throughout the organic material and has a dimension of about 5 nm to about 1000 nm, and wherein the transparent window has a total light transmittance of about 30% or more at at least one wavelength in the range of about 200 nm to about 10,000 nm, and (c) a carrier that holds a substrate to be polished by contacting the rotating polishing pad.

24. The chemical-mechanical polishing apparatus of claim 23, further comprising an in situ polishing endpoint detection system.

25. A method of polishing a workpiece comprising (i) providing a polishing pad comprising a transparent window, wherein the transparent window comprises at least one inorganic material and at least one organic material, wherein the inorganic material is dispersed throughout the organic material and has a dimension of about 5 nm to about 1000 nm, and wherein the transparent window has a total light transmittance of about 30% or more at at least one wavelength in the range of about 200 nm to about 10,000 nm, (ii) contacting a workpiece with the polishing pad, and (iii) moving the polishing pad relative to the workpiece to abrade the workpiece and thereby polish the workpiece.

26. A polishing pad for chemical-mechanical polishing comprising a transparent window, wherein the transparent window comprises an inorganic/organic hybrid sol-gel material.

27. The polishing pad of claim 26, wherein the transparent window has a total light transmittance of about 10% or more at at least one wavelength in the range of about 200 nm to about 10,000 nm.

28. The polishing pad of claim 27, wherein hybrid sol-gel material is a metal oxide-polymer hybrid material or a clay-polyamide hybrid material.

29. A chemical-mechanical polishing apparatus comprising:

(a) a platen that rotates, (b) a polishing pad comprising a transparent window, wherein the transparent window comprises an inorganic/organic hybrid sol-gel material, and (c) a carrier that holds a substrate to be polished by contacting the rotating polishing pad.

30. The chemical-mechanical polishing apparatus of claim 29, further comprising an in situ polishing endpoint detection system.

31. A method of polishing a workpiece comprising (i) providing a polishing pad comprising a transparent window, wherein the transparent window comprises an inorganic/organic hybrid sol-gel material, (ii) contacting a workpiece with the polishing pad, and (iii) moving the polishing pad relative to the workpiece to abrade the workpiece and thereby polish the workpiece.

32. A polishing pad for chemical-mechanical polishing comprising a transparent window, wherein the transparent window comprises at least one polymeric resin and at least one clarifying material, wherein the transparent window has a total light transmittance that is substantially higher than a window comprising only the polymeric resin.

33. The polishing pad of claim 32, wherein the transparent window has a total light transmittance of about 30% or more at at least one wavelength in the range of about 200 nm to about 10,000 nm.

34. The polishing pad of claim 33, wherein the transparent window has a total light transmittance of about 30% or more at at least one wavelength in the range of about 200 nm to about 1,000 nm.

35. The polishing pad of claim 32, wherein the clarifying material is selected from the group consisting of phyllosilicate clays, micas, metal oxides, inorganic salts, polysaccharides, polymer fibers, and combinations thereof.

36. The polishing pad of claim 35, wherein the clarifying material is a phyllosilicate clay having an aspect ratio of about 100 to about 200 and is selected from the group consisting of talc, kaolinite, montmorillonite, hectorite, and combinations thereof.

37. The polishing pad of claim 35, wherein the metal oxide is titania.

38. The polishing pad of claim 35, wherein the inorganic salt is calcium carbonate or sodium benzoate.

39. The polishing pad of claim 32, wherein the polymer resin is selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof.

40. The polishing pad of claim 39, wherein the polymer resin is nylon, and the clarifying material is talc, montmorillonite, fluorinated mica, or a combination thereof.

41. The polishing pad of claim 39, wherein the polymer resin is polypropylene, and the clarifying material is talc, titania, sodium benzoate, a polysaccharide, calcium carbonate, or a combination thereof.

42. The polishing pad of claim 39, wherein the polymer resin is polyethylene, and the clarifying material is talc.

43. The polishing pad of claim 32, wherein the amount of the clarifying material is about 0.0001 wt. % or more, based on the total weight of the transparent window.

* * * * *